US011069296B2

(12) United States Patent
Lan et al.

(10) Patent No.: US 11,069,296 B2
(45) Date of Patent: Jul. 20, 2021

(54) REGULATING DEVICE AND REGULATING METHOD FOR GRAY SCALE VOLTAGE, AND DISPLAY DEVICE

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Chuanyan Lan, Beijing (CN); Lixia Shen, Beijing (CN); Yong Yu, Beijing (CN)

(73) Assignees: Chengdu BOE Optoelectronics Technology Co., Ltd., Sichuan (CN); BOE Technology Group Co., Ltd., Beijing (CN)

( * ) Notice: Subject to any disclaimer, the term of this patent is extended or adjusted under 35 U.S.C. 154(b) by 13 days.

(21) Appl. No.: 16/608,524

(22) PCT Filed: May 16, 2019

(86) PCT No.: PCT/CN2019/087222
§ 371 (c)(1),
(2) Date: Oct. 25, 2019

(87) PCT Pub. No.: WO2020/042673
PCT Pub. Date: Mar. 5, 2020

(65) Prior Publication Data

US 2020/0388221 A1 Dec. 10, 2020

(30) Foreign Application Priority Data

Aug. 30, 2018 (CN) ..... 201811000940.5

(51) Int. Cl.
*G09G 3/3258* (2016.01)
*G09G 3/20* (2006.01)

(52) U.S. Cl.
CPC ..... *G09G 3/3258* (2013.01); *G09G 3/2007* (2013.01); *G09G 2320/0233* (2013.01)

(58) Field of Classification Search
CPC ..... G09G 3/3258; G09G 3/2007; G09G 2320/0233
See application file for complete search history.

(56) References Cited

U.S. PATENT DOCUMENTS 5,495,287 A 2/1996 Kasai et al.
10,304,391 B2 * 5/2019 Ge ..... G09G 3/3233
(Continued)

FOREIGN PATENT DOCUMENTS

CN 1744188 A 3/2006
CN 1905623 A 1/2007
(Continued)

OTHER PUBLICATIONS

First Office Action for CN Appl. No. 201811000940.5, dated May 7, 2020.

*Primary Examiner* — Dmitriy Bolotin
(74) *Attorney, Agent, or Firm* — The Webb Law Firm

(57) ABSTRACT

The invention provides a regulating device and a regulating method for a gray scale voltage, and a display device. The regulating device includes a voltage dividing circuit configured to generate a gray scale voltage according to a first input voltage and a second input voltage; a first voltage regulator configured to regulate a first fixed voltage to output the first input voltage, such that the voltage dividing circuit can generate a predetermined number of gray scale steps for all display brightness.

6 Claims, 3 Drawing Sheets

(56) References Cited

U.S. PATENT DOCUMENTS

| | | | | |
|---|---|---|---|---|
| 2013/0176349 | A1* | 7/2013 | Park | G09G 3/3291 345/690 |
| 2015/0310827 | A1 | 10/2015 | Song et al. | |
| 2017/0206848 | A1* | 7/2017 | Jeon | G09G 3/2007 |
| 2019/0114965 | A1* | 4/2019 | Lim | H01L 51/50 |

FOREIGN PATENT DOCUMENTS

| | | | |
|---|---|---|---|
| CN | 101286743 | A | 10/2008 |
| CN | 101751842 | A | 6/2010 |
| CN | 103021365 | A | 4/2013 |
| CN | 103390393 | A | 11/2013 |
| CN | 103985356 | A | 8/2014 |
| CN | 104021767 | A | 9/2014 |
| CN | 104464627 | A | 3/2015 |
| CN | 104732949 | A | 6/2015 |
| CN | 105096800 | A | 11/2015 |
| CN | 105280128 | A | 1/2016 |

* cited by examiner

REGULATING DEVICE AND REGULATING METHOD FOR GRAY SCALE VOLTAGE, AND DISPLAY DEVICE

CROSS-REFERENCE TO RELATED APPLICATIONS

The present application is a U.S. National Stage Application under 35 U.S.C. § 371 of International Patent Application No. PCT/CN2019/087222, filed on May 16, 2019, which claims priority to China Patent Application No. 201811000940.5, filed on Aug. 30, 2018, the disclosure of both of which are incorporated by reference hereby in entirety into the present application.

TECHNICAL FIELD

The present disclosure relates to the field of display technologies, and in particular, to a regulating device and a regulating method for a gray scale voltage, and a display device.

BACKGROUND

In a display panel such as an AMOLED (Active Matrix Organic Light Emitting Diode), a plurality of pixel units are provided. A luminance of the pixel unit is determined by a gray scale voltage provided by a voltage dividing circuit. In the related art, an input voltage of the voltage dividing circuit is a fixed value.

SUMMARY

According to a first aspect of the embodiments of the present disclosure, there is provided a regulating device for a gray scale voltage including: a voltage dividing circuit configured to generate a gray scale voltage according to a first input voltage and a second input voltage; a first voltage regulator configured to regulate a first fixed voltage to output the first input voltage, such that the voltage dividing circuit can generate a predetermined number of gray scale steps for all display brightness.

In some embodiments, the first input voltage is greater than the second input voltage.

In some embodiments, the first voltage regulator is configured to regulate the first fixed voltage with a first reference voltage to obtain the first input voltage.

In some embodiments, the first voltage regulator is a voltage amplifier.

In some embodiments, the regulating device further comprises: a second voltage regulator configured to regulate a second fixed voltage to output the second input voltage.

In some embodiments, the second voltage regulator is configured to regulate the second fixed voltage with a second reference voltage to obtain the second input voltage.

In some embodiments, the second voltage regulator is a voltage amplifier.

In some embodiments, the regulating device further comprises: a voltage controller configured to output the first reference voltage and the second reference voltage according to a required display brightness.

According to a second aspect of the embodiments of the present disclosure, there is provided a display device including the regulating device for the gray scale voltage, wherein the regulating device comprises: a voltage dividing circuit configured to generate a gray scale voltage according to a first input voltage and a second input voltage; a first voltage regulator configured to regulate a first fixed voltage to output the first input voltage, such that the voltage dividing circuit can generate a predetermined number of gray scale steps for all display brightness.

In some embodiments, the first input voltage is greater than the second input voltage.

In some embodiments, the first voltage regulator is configured to regulate the first fixed voltage with a first reference voltage to obtain the first input voltage.

In some embodiments, the regulating device further comprises: a second voltage regulator configured to regulate a second fixed voltage to output the second input voltage.

In some embodiments, the second voltage regulator is configured to regulate the second fixed voltage with a second reference voltage to obtain the second input voltage.

In some embodiments, the regulating device further comprises: a voltage controller configured to output the first reference voltage and the second reference voltage according to a required display brightness.

According to a third aspect of the disclosed embodiments, there is provided a regulating method for a gray scale voltage including: regulating a first fixed voltage to obtain a first input voltage; inputting the first input voltage and a second input voltage into a voltage dividing circuit to generate a gray scale voltage, such that the voltage dividing circuit can generate a predetermined number of gray scale steps for all display brightness.

In some embodiments, the first input voltage is greater than the second input voltage.

In some embodiments, the regulating the first fixed voltage includes: regulating the first fixed voltage with a first reference voltage to obtain the first input voltage.

In some embodiments, the adjusting method further includes: regulating a second fixed voltage to obtain the second input voltage.

In some embodiments, the regulating the second fixed voltage includes: regulating the second fixed voltage with a second reference voltage to obtain the second input voltage.

In some embodiments, the regulating method further comprises: determining the first reference voltage and the second reference voltage according to the required display brightness.

Further features of the present disclosure, as well as advantages thereof, will become clearer from the following detailed description of exemplary embodiments of the present disclosure with reference to the accompanying drawings.

BRIEF DESCRIPTION OF THE DRAWINGS

The accompanying drawings, which are incorporated in and constitute a part of this specification, illustrate embodiments of the disclosure together with the description, for explaining the principles of the disclosure.

The present disclosure will become more fully understood from the detailed description given herein below and the accompanying drawings, wherein.

Figure 1:
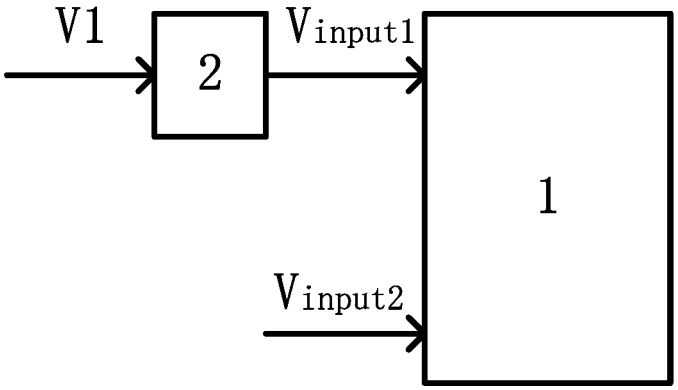
FIG. 1 is a schematic diagram of a regulating device for a gray scale voltage according to one embodiment of the present disclosure.

It should be understood that the dimensions of the various parts illustrated in the drawings are not drawn to the actual scale. Further, the same or similar reference signs denote the same or similar members.

DETAILED DESCRIPTION

Various exemplary embodiments of the present disclosure will now be described in detail with reference to the accompanying drawings. The description of the exemplary embodiments is merely exemplary in nature and is in no way intended to limit the disclosure, its application, or uses. The present disclosure may be embodied in many different forms and is not limited to the embodiments described herein. These embodiments are provided so that this disclosure will be thorough and complete, and will fully convey the scope of the disclosure to those skilled in the art. It should be noted that: the relative arrangement of parts and steps, the composition of materials, and numerical values set forth in these embodiments are to be construed as exemplary only and not limiting unless otherwise specifically noted.

The use of "first", "second", and similar terms in this disclosure does not denote any order, quantity, or importance, but rather the terms are used to distinguish one element from another. The word "comprising" or "including", and the like, means that elements preceding the word encompass elements listed after the word, and do not exclude the possibility of other elements also being encompassed.

All terms (including technical or scientific terms) used in the present disclosure have the same meaning as commonly understood by one of ordinary skill in the art to which the present disclosure belongs, unless otherwise specifically defined. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Techniques, methods, and apparatus known to those of ordinary skill in the relevant art may not be discussed in detail, but are to be considered a part of the specification where appropriate.

The inventors of the present disclosure have found that, in the related art, since the input voltage of the voltage dividing circuit is the fixed value, a step voltage generated by the voltage dividing circuit is also fixed. In the case of low gray scale and low brightness, since a voltage interval used in practice is small, the number of steps used in practice is reduced, so that a sufficient step voltage cannot be obtained, which causes a decrease in display effect. For example, if potentials input from two input terminals of the voltage dividing circuit are 6 volts and 1 volt, respectively, the voltage across the two input terminals is 5 volts. If the display data is 10 bit, the voltage across the two input terminals is divided into 1024 steps, and a step voltage of each step is 0.005 volt. In the case of a pixel brightness of 400 nit, the gray scale voltage actually used is between 1 volt and 6 volts, and the number of steps that can be used at this time is 1024. In the case of a pixel brightness of 5 nit, the gray scale voltage actually used is between 1 and 2 volts. Since in the 1024 steps, only 204 steps are between 1 and 2 volts, and the other 820 steps are between 2 and 6 volts. In this case, only 204 steps can be used. Because sufficient step voltage cannot be obtained, the low gray scale image transition effect is poor.

Accordingly, the present disclosure provides a gray scale voltage regulation scheme, which regulates an input voltage of the voltage dividing circuit so that the voltage dividing circuit generates a predetermined number of gray scale steps for a required display brightness, thereby improving a display effect.

FIG. 1 is a schematic diagram of a regulating device for a gray scale voltage according to one embodiment of the present disclosure. As shown in FIG. 1, the regulating device includes a voltage dividing circuit 1 and a first voltage regulator 2.

The voltage dividing circuit 1 is configured to generate a gray scale voltage according to a first input voltage $V_{input1}$ and a second input voltage $V_{input2}$. The first voltage regulator 2 is configured to regulate a first fixed voltage V1 to output the first input voltage $V_{input1}$, so that the voltage dividing circuit 1 can generate a predetermined number of gray scale steps for all display brightness.

In some embodiments, the first input voltage $V_{input1}$ is greater than the second input voltage $V_{input2}$.

In the regulating device for the gray scale voltage provided in the embodiments of the present disclosure, the magnitude of the input voltage of the voltage dividing circuit is adjusted, so that the voltage dividing circuit can generate a predetermined number of gray scale steps for all display brightness, thereby improving the precision of the step voltage under the condition of low gray scale and low brightness, and effectively improving the transition effect of the low gray scale picture.

For example, the potentials input from the two input terminals of the voltage dividing circuit are 6 volts and 1 volt, respectively, and the voltage across the two input terminals is 5 volts. In the case of a pixel brightness of 400 nit, the voltage across the two input terminals is divided into 1024 steps, with a step voltage of 0.005 volts. However, in the case of a pixel brightness of 5 nit, the voltage across the two input terminals is changed to 1 volt by adjusting the input potential from 6 volts to 2 volts. In the case where the voltage across the two input terminals is divided into 1024 steps, the step voltage is 0.001 v. That is, in the case where the pixel luminance is 5 nit, the number of steps that can be used is still 1024. Obviously, by adjusting the input voltage of the voltage division circuit, the voltage division circuit can generate a predetermined number of gray scale steps for all display brightness, so that the precision of the step voltage can be improved under the condition of low gray scale and low brightness, and the transition effect of a low gray scale picture is effectively improved.

Figure 2:
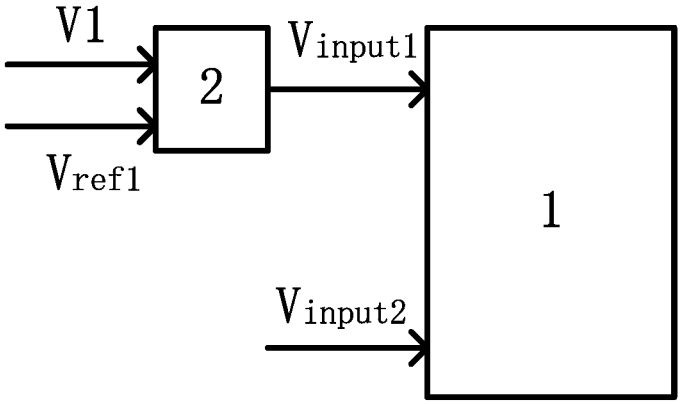
FIG. 2 is a schematic diagram of a regulating device for a gray scale voltage according to another embodiment of the present disclosure.

FIG. 2 is a schematic diagram of a regulating device for a gray scale voltage according to another embodiment of the present disclosure.

As shown in FIG. 2, a first input end of the first voltage regulator 2 is configured to receive the first fixed voltage V1. A second input end of the first voltage regulator 2 is configured to receive a first reference voltage $V_{ref1}$. The first voltage regulator 2 regulates the first fixed voltage V1 with the first reference voltage $V_{ref1}$. An output end of the first voltage regulator 2 is configured to output a first input voltage $V_{input1}$. The first fixed voltage V1 is regulated by using the first reference voltage $V_{ref1}$, so as to obtain the required first input voltage $V_{input1}$.

In some embodiments, the first fixed voltage V1 is 6 volts. The first input voltage $V_{input1}$ of the voltage dividing circuit needs to be adjusted to 2 volts according to the current display brightness. In this case, the first voltage regulator 2 regulates the first fixed voltage V1 with the first reference voltage $V_{ref1}$ to output the first input voltage $V_{input1}$ of 2 volts.

In some embodiments, the first voltage regulator 2 is a voltage amplifier, or other device capable of regulating a voltage value.

Figure 3:
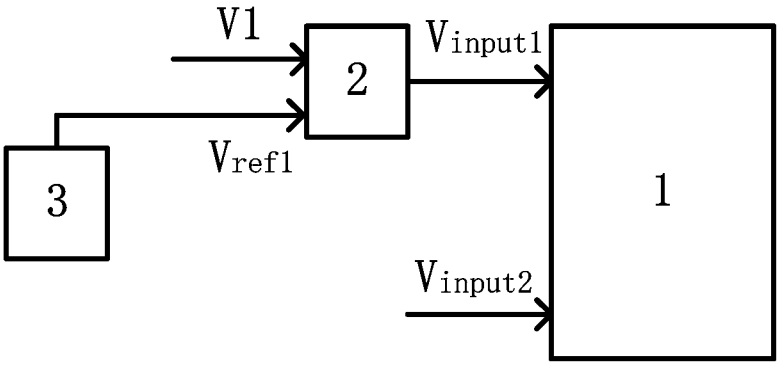
FIG. 3 is a schematic diagram of a regulating device for a gray scale voltage according to still another embodiment of the present disclosure.

FIG. 3 is a schematic diagram of a regulating device for a gray scale voltage according to another embodiment of the present disclosure. FIG. 3 differs from FIG. 2 in that, the regulating device further includes a voltage controller 3 in the embodiment shown in FIG. 3.

The voltage controller 3 is configured to output the first reference voltage $V_{ref1}$ according to a required display brightness.

For example, the voltage controller 3 outputs the corresponding first reference voltage $V_{ref1}$ according to a required display brightness, based on a predetermined correspondence between the display brightness and the input voltage of the voltage dividing circuit. The first voltage regulator 2 regulates the first fixed voltage V1 with the first reference voltage $V_{ref1}$ to obtain a required first input voltage $V_{input1}$.

Figure 4:
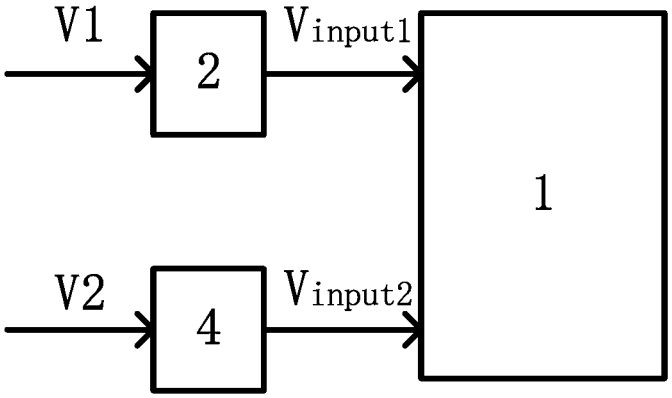
FIG. 4 is a schematic diagram of a regulating device for a gray scale voltage according to still another embodiment of the present disclosure.

FIG. 4 is a schematic structural diagram of a regulating device for a gray scale voltage according to another embodiment of the present disclosure. FIG. 4 differs from FIG. 1 in that, the regulating device further includes a second voltage regulator 4 in the embodiment shown in FIG. 4.

The second voltage regulator 4 is configured to regulate a second fixed voltage V2 to output the second input voltage $V_{input2}$. That is, in the embodiment shown in FIG. 4, the input voltages of both input terminals of the voltage dividing circuit can be adjusted as required. Therefore, the input voltage interval of the voltage dividing circuit can be adjusted as required.

Figure 5:
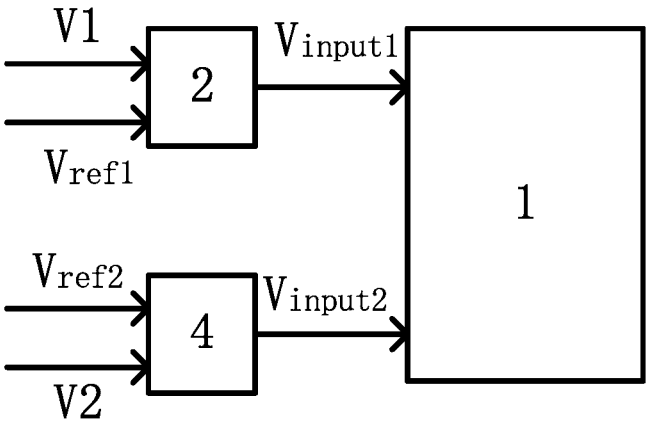
FIG. 5 is a schematic diagram of a regulating device for a gray scale voltage according to still another embodiment of the present disclosure.

FIG. 5 is a schematic structural diagram of a regulating device for a gray scale voltage according to another embodiment of the present disclosure.

As shown in FIG. 5, a first input end of the second voltage regulator 4 is configured to receive the second fixed voltage V2. A second input end of the second voltage regulator 4 is configured to receive a second reference voltage $V_{ref2}$. The second voltage regulator 4 regulates the second fixed voltage V2 with the second reference voltage $V_{ref2}$, so as to obtain the required second input voltage $V_{input2}$.

In some embodiments, the first fixed voltage V1 is 6 volts and the second fixed voltage V2 is 1 volt. According to the current display brightness, the first input voltage $V_{input1}$ of the voltage dividing circuit needs to be adjusted to 5 volts, and the second input voltage $V_{input1}$ of the voltage dividing circuit needs to be adjusted to 2 volts. In this case, the first voltage regulator 2 regulates the first fixed voltage V1 with the first reference voltage $V_{ref1}$ to output the first input voltage $V_{input1}$ of 5 volts. The second voltage regulator 4 regulates the second fixed voltage V2 with the second reference voltage $V_{ref2}$ to obtain a second input voltage $V_{input2}$ of 2 volts.

In some embodiments, the second voltage regulator 4 is a voltage amplifier, or other devices capable of regulating a voltage value.

Figure 6:
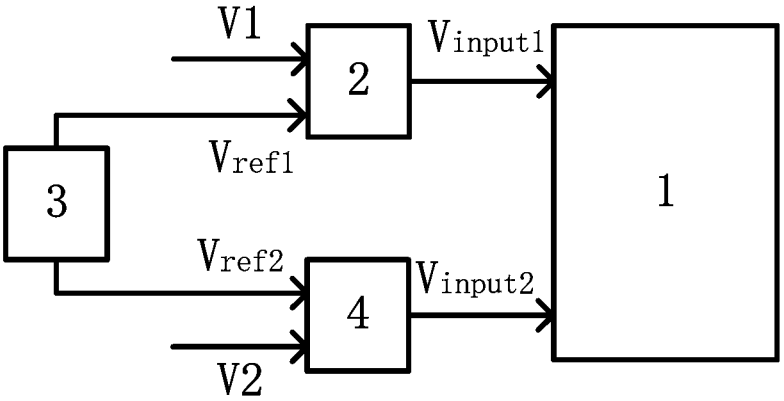
FIG. 6 is a schematic diagram of a regulating device for a gray scale voltage according to still another embodiment of the present disclosure.

FIG. 6 is a schematic structural diagram of a regulating device for a gray scale voltage according to another embodiment of the present disclosure.

FIG. 6 differs from 3 in that, in the embodiment shown in FIG. 6, the voltage controller 3 further outputs the second reference voltage $V_{ref2}$ according to the required display brightness, in addition to outputting the first reference voltage $V_{ref1}$ according to the required display brightness. Thus, the two input voltages of the voltage dividing circuit can be adjusted by the control of the voltage controller 3.

The embodiment of the present disclosure further provides a display device, which includes any one of the above adjusting devices for the gray scale voltage. The display device may be: LCD (Liquid Crystal Display), LED (Light Emitting Diode) Display, OLED (Organic Light Emitting Diode), QLED (Quantum Dot Light Emitting Diode) Display, AMOLED Display, mobile phone, tablet computer, TV, notebook computer, digital photo frame, navigator, and any other product or component having a Display function.

Figure 7:
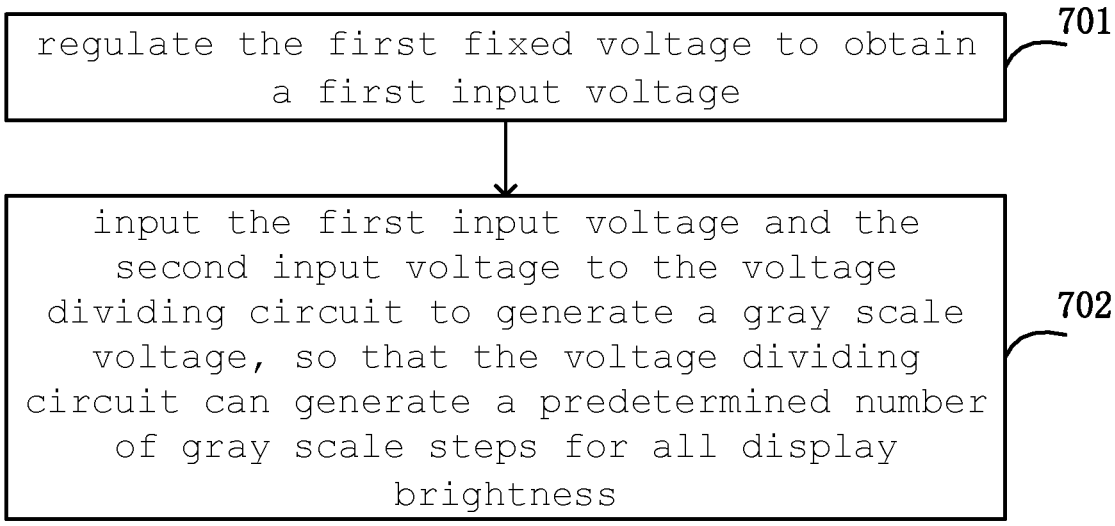
FIG. 7 is a flowchart illustrating a regulating method for a gray scale voltage according to one embodiment of the present disclosure.

FIG. 7 is a flowchart illustrating a regulating method for a gray scale voltage according to one embodiment of the present disclosure.

In step 701, a first fixed voltage regulated to obtain a first input voltage.

In some embodiments, the first fixed voltage is adjusted by using a first reference voltage to obtain a first input voltage. For example, the magnitude of the first reference voltage may be determined according to a required display brightness.

In some embodiments, the first fixed voltage V1 is 6 volts. The first input voltage $V_{input1}$ of the voltage dividing circuit needs to be adjusted to 2 volts according to the current display brightness. In this case, the first fixed voltage V1 is regulated by using the first reference voltage $V_{ref1}$ to obtain the first input voltage $V_{input1}$ of 2 volts.

In step 702, the first input voltage and the second input voltage are input to the voltage dividing circuit to generate a gray scale voltage, so that the voltage dividing circuit can generate a predetermined number of gray scale steps for all display brightness.

In some embodiments, the second input voltage is obtained by regulating the second fixed voltage.

In some embodiments, the second fixed voltage is adjusted by using a second reference voltage to obtain a second input voltage. For example, the second reference voltage may be determined according to a required display brightness.

In some embodiments, the first fixed voltage V1 is 6 volts and the second fixed voltage V2 is 1 volts. According to the current display brightness, the first input voltage $V_{input1}$ of the voltage dividing circuit needs to be adjusted to 5 volts, and the second input voltage $V_{input2}$ of the voltage dividing circuit needs to be adjusted to 2 volts. In this case, the first fixed voltage V1 is regulated by using the first reference voltage $V_{ref1}$, so as to output the first input voltage $V_{input1}$ of 5 volts. The second fixed voltage V2 is regulated by using the second reference voltage $V_{ref2}$, so as to obtain the second input voltage $V_{input2}$ of 2 volts.

In some embodiments, the first input voltage is greater than the second input voltage.

According to the regulating method for a gray scale voltage provided by the embodiment of the present disclosure, the input voltage of the voltage dividing circuit is adjusted, so that the voltage dividing circuit can generate a predetermined number of gray scale steps for all display brightness. Therefore, the precision of the step voltage can be improved under the condition of low gray scale and low brightness, and the transition effect of a low gray scale picture can be effectively improved.

So far, embodiments of the present disclosure have been described in detail. Some details that are known in the art are described in order to avoid obscuring the concepts of the present disclosure. Those skilled in the art can fully understand how to implement the technical solutions disclosed herein based on the above description.

While certain specific embodiments of the present disclosure have been described in detail by way of example, it should be understood by those skilled in the art that the above examples are illustrative only and are not intended to limit the scope of the present disclosure. It will be understood by those skilled in the art that modifications may be made to the above embodiments or equivalents may be substituted for elements thereof without departing from the scope and spirit of the present disclosure. The scope of the present disclosure is defined by the appended claims.

What is claimed is:

1. A regulating device for a gray scale voltage, comprising:

a voltage dividing circuit configured to generate a gray scale voltage according to a first input voltage and a second input voltage to generate a predetermined number of gray scale steps for all display brightness;

a first voltage regulator, wherein the first voltage regulator is a voltage amplifier and is configured to amplify a first fixed voltage with a first reference voltage to output the first input voltage, and the first fixed voltage is used to determine an amplification gain of the first voltage regulator; and a second voltage regulator, wherein the second voltage regulator is a voltage amplifier regulator and is configured to amplify a second fixed voltage with a second reference voltage to output the second input voltage, and the second fixed voltage is used to determine an amplification gain of the second voltage regulator.

2. The regulating device according to claim 1, wherein the first input voltage is greater than the second input voltage.

3. The regulating device according to claim 1, further comprising:

a voltage controller configured to output the first reference voltage and the second reference voltage according to a required display brightness.

4. A display device, comprising a regulating device for a gray scale voltage, wherein the regulating device comprises:

a voltage dividing circuit configured to generate a gray scale voltage according to a first input voltage and a second input voltage to generate a predetermined number of gray scale steps for all display brightness;

a first voltage regulator, wherein the first voltage regulator is a voltage amplifier and is configured to amplify a first fixed voltage with a first reference voltage to output the first input voltage, and the first fixed voltage is used to determine an amplification gain of the first voltage regulator; and a second voltage regulator, wherein the second voltage regulator is a voltage amplifier regulator and is configured to amplify a second fixed voltage with a second reference voltage to output the second input voltage, and the second fixed voltage is used to determine an amplification gain of the second voltage regulator.

5. The display device according to claim 4, wherein the first input voltage is greater than the second input voltage.

6. The display device of claim 4, wherein the regulating device further comprises:

a voltage controller configured to output the first reference voltage and the second reference voltage according to a required display brightness.

* * * * *